US007988488B2

(12) United States Patent
Orlando

(10) Patent No.: US 7,988,488 B2
(45) Date of Patent: Aug. 2, 2011

(54) BARREL NUT CONNECTOR ASSEMBLY

(75) Inventor: Jason John Orlando, Riviera Beach, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 314 days.

(21) Appl. No.: 12/437,313

(22) Filed: May 7, 2009

(65) Prior Publication Data

US 2010/0285673 A1 Nov. 11, 2010

(51) Int. Cl.
*H01R 13/73* (2006.01)

(52) U.S. Cl. ..... 439/551

(58) Field of Classification Search ..... 439/550, 439/551

See application file for complete search history.

(56) References Cited

U.S. PATENT DOCUMENTS

| | | | | | |
|---|---|---|---|---|---|
| 3,601,769 | A | | 8/1971 | Oliver et al. | |
| 3,624,585 | A | * | 11/1971 | Kokalas et al. | 439/195 |
| 3,626,356 | A | | 12/1971 | Trammell | |
| 3,719,918 | A | | 3/1973 | Kerr | |
| 3,750,088 | A | | 7/1973 | Berian | |
| 3,868,806 | A | | 3/1975 | Dey | |
| 3,963,297 | A | | 6/1976 | Panek et al. | |
| 3,980,984 | A | | 9/1976 | Bridges | |
| 4,192,569 | A | | 3/1980 | Mucci | |
| 4,234,218 | A | * | 11/1980 | Rogers | 285/149.1 |
| 4,346,954 | A | | 8/1982 | Appling | |
| 4,355,855 | A | | 10/1982 | Rebikoff | |
| 4,420,210 | A | | 12/1983 | Karol et al. | |
| 4,795,359 | A | | 1/1989 | Alcock et al. | |
| 4,802,865 | A | * | 2/1989 | Alibert | 439/461 |
| 4,960,391 | A | | 10/1990 | Beinhaur et al. | |
| 5,032,047 | A | | 7/1991 | Theakston | |
| 5,580,273 | A | * | 12/1996 | Krieger et al. | 439/546 |
| 5,866,853 | A | | 2/1999 | Sheehan | |
| 5,912,431 | A | * | 6/1999 | Sheehan | 174/653 |
| 5,931,695 | A | | 8/1999 | Scully et al. | |
| 6,123,578 | A | * | 9/2000 | Truett | 439/551 |
| 6,478,518 | B1 | | 11/2002 | Hwang | |
| 6,506,083 | B1 | * | 1/2003 | Bickford et al. | 439/736 |
| 6,835,093 | B1 | * | 12/2004 | Griffin et al. | 439/551 |
| 6,916,193 | B2 | | 7/2005 | Varreng et al. | |
| 7,220,062 | B2 | | 5/2007 | Durrant et al. | |
| 2004/0077214 | A1 | | 4/2004 | Turek et al. | |
| 2010/0285673 | A1 | * | 11/2010 | Orlando | 439/34 |

OTHER PUBLICATIONS

"Beckson Barrel Nuts", "available at: http://www.beckson.com/bb.html accessed Apr. 11, 2009", 2000, Publisher: Beckson Marine, Inc., Published in: Bridgeport, CT.

* cited by examiner

*Primary Examiner* — James Harvey
(74) *Attorney, Agent, or Firm* — Fogg & Powers LLC

(57) ABSTRACT

A connector assembly comprises a connector having a connector threaded section with threads along a length of an external surface of the connector threaded section; and a barrel nut. The barrel nut comprises a nut threaded section having threads along an internal surface of the nut threaded section, wherein the nut threaded section is barrel shaped having a length and a diameter; a fastening section coupled to the nut threaded section, the fastening section having a length and a non-circular shape comprising a plurality of sides; and a nut circular opening extending through the entire length of the fastening section and the entire length of the nut threaded section; wherein the diameter of the nut threaded section is larger than a diameter of the connector threaded section and smaller than a diameter of an opening in a barrier through which the nut is coupled to the connector.

20 Claims, 4 Drawing Sheets

BARREL NUT CONNECTOR ASSEMBLY

GOVERNMENT LICENSE RIGHTS

This invention was made with Government support under Contract No. 1Q451563000 awarded by the Department of Defense. The Government has certain rights in the invention.

BACKGROUND

In various industries it is sometimes necessary to make an electrical connection across a pressure boundary. For example, in deep sea applications, it is often necessary to connect an electrical cable through the bulkhead of a remotely operated underwater vehicle (ROV) to electronics inside the ROV. In order to withstand the pressure of deep sea applications, ROVs typically have thick bulkheads. The thick bulkheads typically require custom electrical connectors which are long enough to extend completely through the bulkhead and engage a nut on the other side of the bulkhead to secure the connector. However, the long custom connectors are typically more expensive than a standard off-the-shelf connector. In addition, the lead time associated with the custom connectors is usually significantly longer than the lead time associated with standard connectors.

Another disadvantage of the custom connector is that the length of the connector causes a loss in packaging efficiency and reduced reliability of the design due to cable chaffing. The cable chafing is due in part to the high profile of the nut used to engage the custom connector from the inside of the ROV. For example, one or more jam nuts are typically used to secure the custom connector to the bulkhead. The jam nuts have a high profile threaded section which engages the custom connector. Furthermore, when a user attempts to tighten or remove the cable that connects to the connector from outside the ROV, the jam nuts coupled to the custom connector will often spin and come loose entirely. The pressure end cap of the bulkhead must then be removed to access and tighten the internal jam nuts.

SUMMARY

In one embodiment a connector assembly is provided. The connector assembly comprises a connector having a connector threaded section with threads along a length of an external surface of the connector threaded section; and a barrel nut. The barrel nut comprises a nut threaded section having threads along an internal surface of the nut threaded section, wherein the nut threaded section is barrel shaped having a length and a diameter; a fastening section coupled to the nut threaded section, the fastening section having a length and a non-circular shape comprising a plurality of sides; and a nut circular opening extending through the entire length of the fastening section and the entire length of the nut threaded section; wherein the diameter of the nut threaded section is larger than a diameter of the connector threaded section and smaller than a diameter of an opening in a barrier through which the nut is coupled to the connector such that the nut threaded section engages the connector threaded section within the barrier opening when the connector threaded section and the nut threaded section are inserted into the barrier opening.

DRAWINGS

Understanding that the drawings depict only exemplary embodiments and are not therefore to be considered limiting in scope, the exemplary embodiments will be described with additional specificity and detail through the use of the accompanying drawings, in which.

Figure 1:
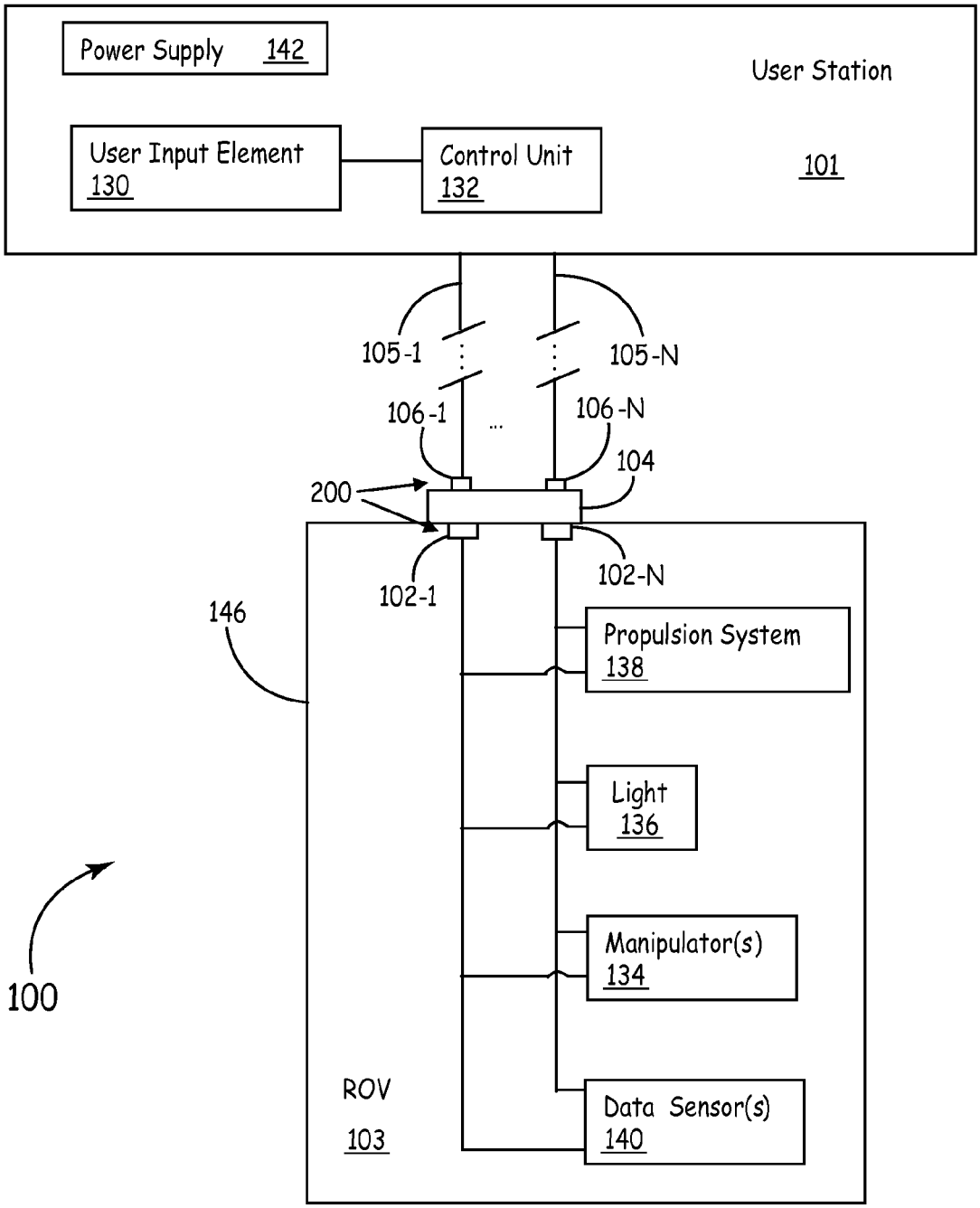
FIG. 1 is a block diagram of one embodiment of an underwater vehicle.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

The embodiments of a connector assembly described below have reduced cost and lead times as compared to typical connector assemblies which use custom connectors. In particular, the exemplary embodiments enable the use of a standard off-the-shelf connector with a custom barrel nut to reduce cost and lead times. In addition, the custom barrel nut has a lower profile than nuts used in typical connector assemblies for connections across a pressure boundary. The custom barrel nut can also be secured against the bulkhead, in some embodiments, so as not to rotate when a cable connected to the standard connector is tightened or removed.

FIG. 1 is a high level block diagram depicting one embodiment of a Remotely Operated underwater Vehicle (ROV) system 100. ROV system 100 includes a user station 101 and a ROV 103 which is tethered to the user station 101 via a plurality of cables 105-1 . . . 105-N. Cables 105-1 . . . 105-N provide electrical power from a power supply 142 to the ROV 103. In addition, cables 105-1 . . . 105-N provide data and control signals between the user station 101 and the ROV 103. Although the embodiments described herein are implemented in a tethered ROV, it is to be understood that other embodiments are implemented in other vehicles such as an untethered ROV or an Autonomous Underwater Vehicle (AUV).

In this embodiment, ROV 103 includes a propulsion system 138, a light 136, one or more manipulators 134, and one or more data sensors 140. Electrical connectors to each of the propulsion system 138, the light 136, the one or more manipulators 134, and the one or more data sensors 140 are located within a watertight compartment formed by the bulkhead 146. However, it is to be understood that physical portions of the above devices can be located outside of the bulkhead 146. For example, the manipulators 134 are extendable arms for grasping, cutting, etc. The extendable arms are located outside the bulkhead while the electrical connectors for receiving power and control signals are located within the watertight cavity. In addition, in some embodiments, a connector assembly, such as connector assembly 200 described below, can be used for the electrical connectors of the above devices.

In response to inputs from user input element 130, control unit 132 provides control signals to the ROV 103. For example, the control signals can turn on/off the light 136, provide navigation instructions to the propulsion system 138, and/or operate the manipulators 134. One or more data sensors 140 provide data to the user station via cables 105-1 . . . 105-N. For example, sensors 140 can include, but are not limited to, temperature sensors, light sensors, video cameras, still cameras, magnetometers, SOund Navigation And Ranging (SONAR) sensors, etc.

Cables 105-1 . . . 105-N are coupled to the ROV through a barrier 104 (e.g. a bulkhead end cap of the ROV 103 in this embodiment). In particular, a connector assembly 200 couples each of the cables 105 through the end cap 104 to the devices within the ROV 103. In addition, the connector assembly 200 is used, in some embodiments, to connect other cables through the end cap 104, such as cables connecting devices of the ROV 103. The connector assembly 200 includes a standard off-the-shelf connector 102 and a barrel nut 106. An exemplary connector assembly 200 is shown in more detail in FIGS. 2A and 2B.

Figure 2A:
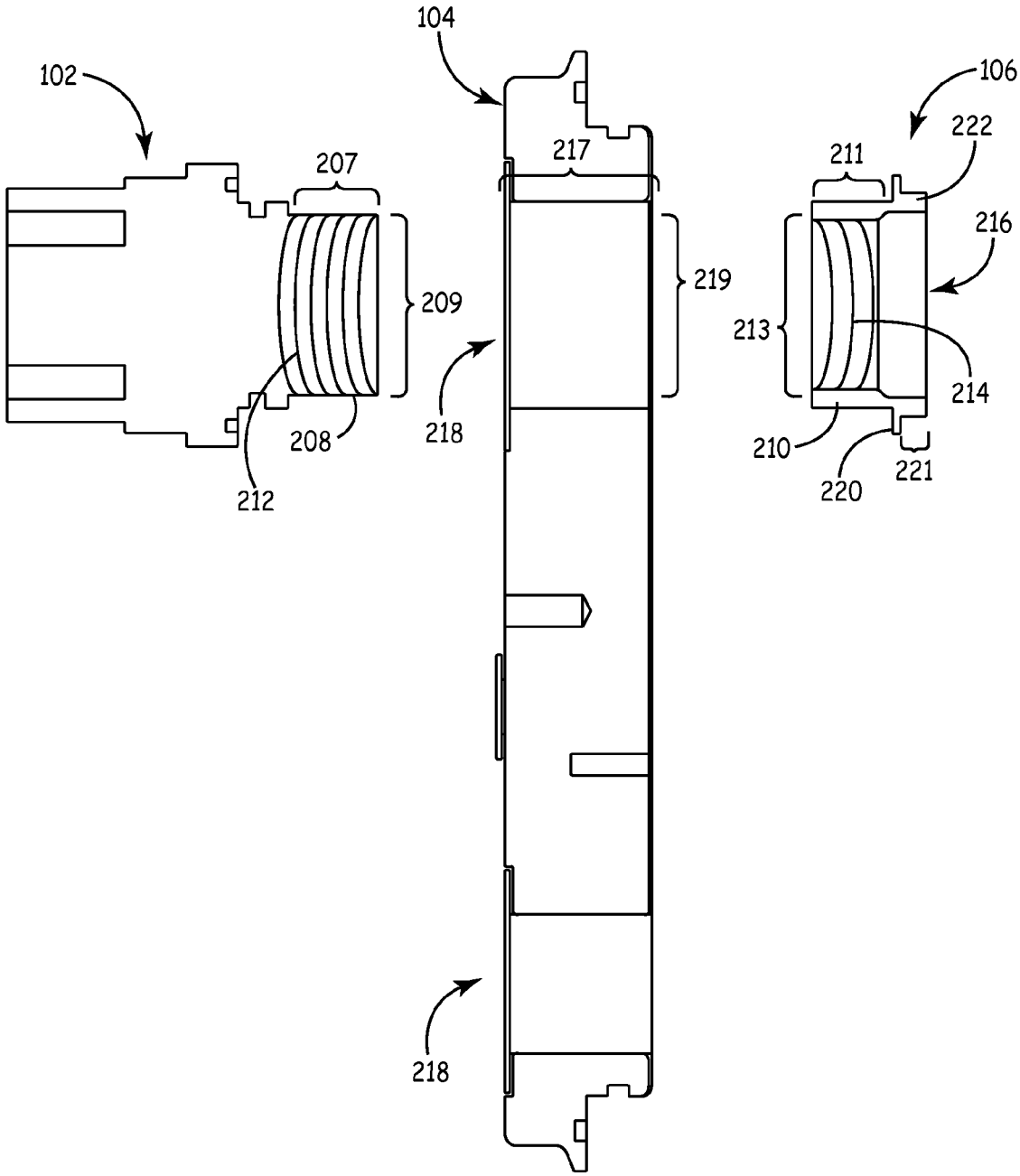
FIG. 2A is an exploded cross-sectional view of one embodiment of a connector assembly.

FIG. 2A is an exploded cross-sectional view of one embodiment of a connector assembly 200 comprising the standard off-the-shelf connector 102 and the barrel nut 106. The standard connector 102 is coupled through a barrier 104 to the barrel nut 106. As stated above, in this exemplary embodiment, the barrier 104 is a bulkhead end cap of a pressure vessel such as the ROV 103. Since the barrier 104 forms part of a pressure boundary, it needs a thickness sufficient to resist the pressure of deep sea operations (e.g. approximately 1 inch thick or greater). The standard connector 102 includes a threaded section 208 with threads 212 along a length 207 of an external surface of the threaded section 208. The nut 206 also includes a threaded section 210 with threads 214 along a length 211 of an internal surface of the threaded section 210. The thread profile of the threads 214 corresponds to the thread profile of the threads 212.

The diameter 213 of the threaded section 210 is larger than the diameter 209 of the threaded section 108 and smaller than the diameter 219 of an opening 218 in the barrier 104. To engage the threaded section 208, the threaded section 210 is inserted into the opening 208 and engages the threaded section 208 inside the opening 218 (as shown in FIG. 1B), whereas typical custom connectors have a length greater than the width of the barrier 104 and engage a typical nut on the side of the barrier 104 that is opposite the custom connector. Nut 106 also includes a fastening section 222. The shape of the fastening section 222 (shown in more detail in FIG. 3) enables the nut 106 to be fastened by a standard socket wrench or similar tool.

Figure 2B:
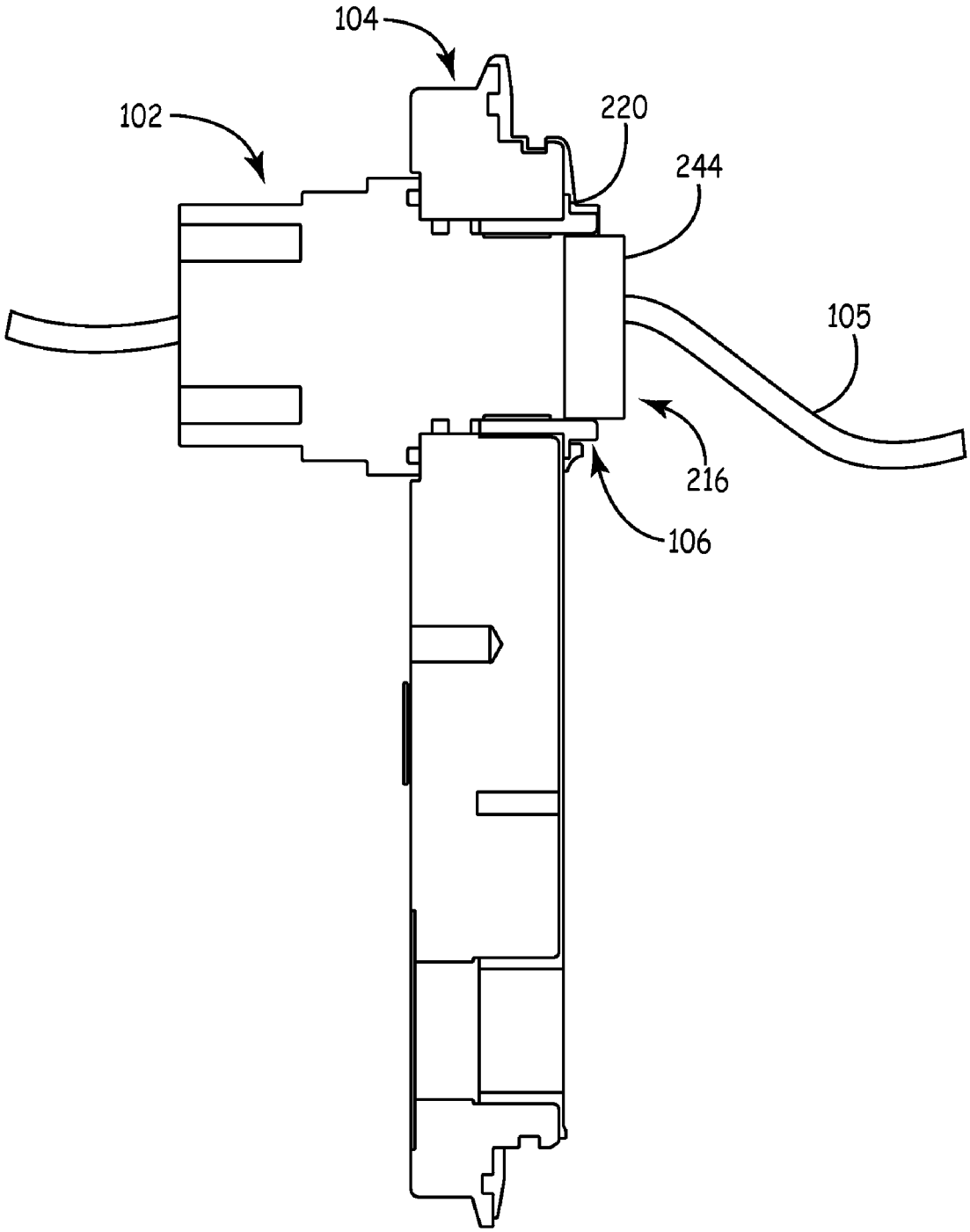
FIG. 2B is a cross-sectional view of the connector assembly in a connected state.

The nut 106 further includes a stop section 220 located between the threaded section 210 and the fastening section 222. The stop section 220 has dimensions (e.g. diameter or length of sides) larger than the diameter of the opening 218 which prevents the nut 106 from being inserted further into the opening 218 when the stop section 220 contacts a surface of the barrier 104 (as shown in FIG. 2B). For example, in this embodiment, the stop section 220 is circular and has a diameter larger than the diameter of the opening 218.

A circular opening 216 extends through each of the fastening section 222, the stop section 220, and the threaded section 210 of nut 106. The cable 105 can be connected to the standard connector 102 through the opening 216 of nut 106 as shown in FIG. 2B. In particular, at the end of the cable 105 is a mating connector 244 which connects to the standard connector 102. For example, in one embodiment, the standard connector 102 is a female connector and the mating connector 244 is a corresponding male connector.

Since the threaded section 210 is inserted into the opening 218 of the barrier 104, threaded section 208 of the connector 102 does not have to be longer than the width 217 of the barrier 104, as in conventional connector assemblies, which enables the use of standard off-the-shelf connectors. In addition, insertion of the threaded section 210 into the opening 218 enables the profile of fastening section 222 to be smaller than the profile of nuts used in conventional connector assemblies. In particular, the length 221 of the fastening section 222 only needs to be sufficiently high to engage a socket wrench or other tool for tightening the nut 106 since the connector 102 is engaged inside the opening 218 by the threaded section 210. Thus, the length 221 of the fastening section 222 can be smaller than the length of the threaded section 210. The smaller profile (i.e. smaller length) of the fastening section 222 helps reduce cable chafing as compared to conventional connector assemblies.

Figure 3:
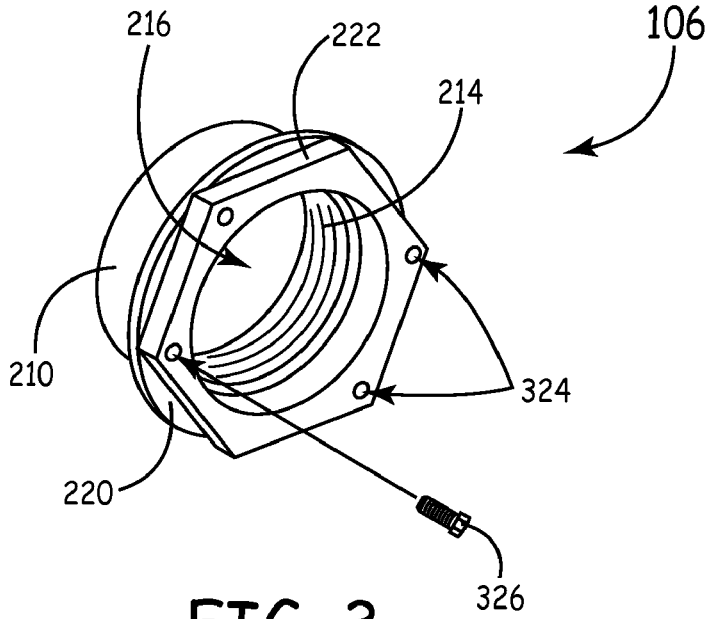
FIG. 3 is a perspective view of one embodiment of a barrel nut used in the connector assembly.

FIG. 3 is a perspective view of one embodiment of the nut 106. The nut 106 can be manufactured from stainless steel or other appropriate material. As described above, the nut 106 includes the threaded section 210, the stop section 220 and the fastening section 222. As shown in the exemplary embodiment of FIG. 3, the length and diameter of the threaded section 210 form a barrel or cylindrical shape. Additionally, as shown in the exemplary embodiment of FIG. 3, the fastening section 222 has a non-circular hexagonal shape having 6 sides. However, it is to be understood that other shapes having a plurality of sides can be used in other embodiments, such as a square or octagonal shape. Furthermore, whereas the hexagonal shape of the fastening section 222 is shown extending away from the stop section 220, thereby giving the fastening section 222 its length, other configurations are used in other embodiments. For example, in one alternative embodiment, the non-circular shape of the fastening section 222 is formed as an indentation in the stop section 220, the length of the fastening section 222 being measured by the depth of the indentation. In such an embodiment, a socket wrench or tool with a matching shape is inserted into the indentation rather than around a raised non-circular shape, as in the embodiment shown in FIG. 3.

In addition, the nut 106 includes set screw holes 324. In particular, in this embodiment, four set screw holes 324 are included in the nut 106. However, it is to be understood that, in other embodiments, other appropriate numbers of set screw holes 324 can be used. After the nut 106 is tightened around the connector 102, set screws 326 are inserted into the set screw holes 324. The tip of each set screw 326 contacts the surface of the barrier 104 and can be in, but is not limited to, a flat shaped, domed shaped, cone shaped, or cup shaped configuration. The contact of the set screws 326 with the surface of the barrier 104 provides pressure against the surface. The frictional force which results from this pressure resists rotation of the nut 106. Thus, the nut 106 is less likely to be loosened when a cable is disconnected from the connector 102 than nuts in conventional connector assemblies.

Figure 4:
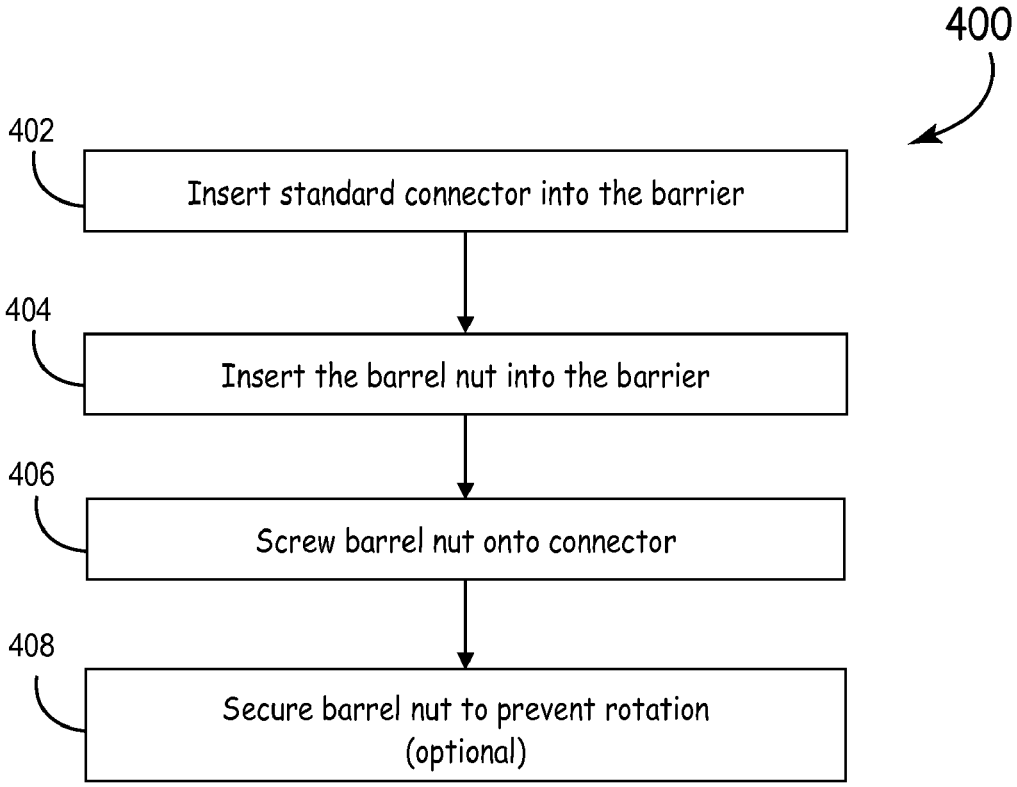
FIG. 4 is flow chart of one embodiment of a method of coupling a connector assembly.

FIG. 4 is a flow chart depicting one embodiment of a method 400 of coupling a connector assembly, such as connector assembly 200 described above. At block 402, a threaded section of a standard off-the-shelf connector is inserted into an opening in a barrier, such as a bulkhead end cap of a pressure vessel. The length of the standard off-the-shelf connector is shorter than the width of the barrier. At block 404, a threaded section of a nut is inserted into the opening of the barrier from the opposite side of the barrier. At block 406, the barrel nut is rotated with respect to the connector so that the threads of the barrel nut engage the threads of the connector within the opening. In particular, a fastening section of the nut is rotated so that the threaded section of the barrel nut is screwed around the threaded section of the connector until a stop section of the nut makes contact with a surface of the barrier. At block 408, the barrel nut is optionally secured to hinder rotation of the barrel nut. In particular, set screws are inserted through corresponding set screw holes in the nut until pressure is applied to the surface of the barrier to hinder rotation of the nut.

Although specific embodiments have been illustrated and described herein, it will be appreciated by those of ordinary skill in the art that any arrangement, which is calculated to achieve the same purpose, may be substituted for the specific embodiments shown. For example, in some embodiments, the stop section 220 and the fastening section 222 of the nut 106 can be incorporated into one section. In particular, the sides of the fastening section 222 can be configured to have a length such that, when rotated, the sides mark out a diameter greater than the diameter of the opening 218 in the barrier 104. Therefore, it is manifestly intended that this invention be limited only by the claims and the equivalents thereof.

What is claimed is:

1. An underwater vehicle comprising:

a bulkhead to form a watertight compartment;

a propulsion system to control movement of the underwater vehicle;

at least one data sensor to collect data; and at least one connector assembly to connect one or more cables to the propulsion system and the at least one data sensor through the bulkhead, each of the propulsion system and the at least one data sensor having an electrical connector located within the watertight compartment;

wherein each of the at least one connector assemblies comprises:

an electrical connector having a connector threaded section with threads along a length of an external surface of the connector threaded section; and a barrel nut comprising:

a nut threaded section having threads along an internal surface of the nut threaded section, wherein the nut threaded section is cylindrically shaped having a length and a diameter;

a fastening section coupled to the nut threaded section, the fastening section having a length and a non-circular shape comprising a plurality of sides; and a nut circular opening extending through the entire length of the fastening section and the entire length of the nut threaded section;

wherein the diameter of the nut threaded section is larger than a diameter of the connector threaded section and smaller than a diameter of an opening in the bulkhead such that the nut threaded section engages the connector threaded section within the bulkhead opening when the connector threaded section and the nut threaded section are inserted into the bulkhead opening.

2. The underwater vehicle of claim 1, wherein the at least one data sensor comprises one or more of a temperature sensor, a light sensor, a video camera, a still camera, a magnetometer, or a SOund Navigation And Ranging (SONAR) sensor.

3. The underwater vehicle of claim 1, further comprising at least one manipulator having an electrical connector located within the watertight compartment, wherein one of the at least one connector assemblies couples the at least one manipulator through the bulkhead to a user station via one or more cables.

4. The underwater vehicle of claim 1, wherein the connector assembly further comprises a plurality of set screws; and wherein the barrel nut further comprises a plurality of set screw holes such that when inserted into the corresponding set screw holes, the plurality of set screws apply pressure against a surface of the bulkhead which hinders rotation of the barrel nut.

5. The underwater vehicle of claim 1, wherein the fastening section of the barrel nut comprises six sides forming a hexagonal shape.

6. The underwater vehicle of claim 1, wherein the barrel nut further comprises a circular stop section between the threaded section and the fastening section, the stop section having a diameter larger than the diameter of the threaded section, wherein the circular opening extends through the stop section.

7. The underwater vehicle of claim 1, wherein the length of the connector threaded section is shorter than the width of the bulkhead.

8. The underwater vehicle of claim 1, wherein the underwater vehicle is one of a tethered Remotely Operated underwater Vehicle (ROV), an untethered Remotely Operated underwater Vehicle (ROV), and an Autonomous Underwater Vehicle (AUV).

9. A connector assembly comprising:

an electrical connector having a connector threaded section with threads along a length of an external surface of the connector threaded section; and a barrel nut comprising:

a nut threaded section having threads along an internal surface of the nut threaded section, wherein the nut threaded section is barrel shaped having a length and a diameter;

a fastening section coupled to the nut threaded section, the fastening section having a length and a non-circular shape comprising a plurality of sides; and a nut circular opening extending through the entire length of the fastening section and the entire length of the nut threaded section;

wherein the diameter of the nut threaded section is larger than a diameter of the connector threaded section and smaller than a diameter of an opening in a barrier through which the nut is coupled to the connector such that the nut threaded section engages the connector threaded section within the barrier opening when the connector threaded section and the nut threaded section are inserted into the barrier opening.

10. The connector assembly of claim 9, wherein the barrel nut is comprised of stainless steel.

11. The connector assembly of claim 9, further comprising a plurality of set screws;

wherein the barrel nut further comprises a plurality of set screw holes such that when inserted into the corresponding set screw holes, the plurality of set screws apply pressure against a surface of the barrier which hinders rotation of the barrel nut.

12. The connector assembly of claim 11, wherein the barrel nut comprises four set screw holes.

13. The connector assembly of claim 9, wherein the fastening section comprises six sides forming a hexagonal shape.

14. The connector assembly of claim 9, wherein the barrel nut further comprises a circular stop section between the threaded section and the fastening section, the stop section having a diameter larger than the diameter of the threaded section, wherein the nut circular opening extends through the stop section.

15. The connector assembly of claim 9, wherein the length of the connector threaded section is shorter than the width of the barrier circular opening.

16. The connector assembly of claim 9, wherein the barrier is a bulkhead end cap of a pressure vessel.

17. A method of coupling a connector assembly, the method comprising:

inserting a connector threaded section of a connector into an opening in a barrier from a first side of the barrier, the connector threaded section having threads along a length of an external surface of the connector threaded section;

inserting a nut threaded section of a barrel nut into the barrier opening from a second side of the barrier, the nut threaded section having threads along a length of an internal surface of the nut threaded section, wherein a diameter of the nut threaded section is larger than a diameter of the connector threaded section and smaller than a diameter of the barrier opening; and rotating a non-circular shaped fastening section of the barrel nut to rotate the barrel nut with respect to the connector such that the threads of the nut threaded section engage the threads of the connector threaded section within the barrier opening, an opening extending through the fastening section and threaded section of the nut enabling access to the connector from the second side of the barrier.

18. The method of claim 17, wherein rotating the non-circular shaped fastening section comprises rotating the non-circular shaped fastening section until a stop section between the nut threaded section and the non-circular shaped fastening section contacts a surface of the barrier.

19. The method of claim 17, further comprising inserting at least one set screw through a corresponding set screw hole in the nut until pressure is applied to the surface of the barrier to hinder rotation of the nut.

20. The method of claim 17, wherein the barrier is an end cap of a remotely operated underwater vehicle (ROV).

* * * * *